United States Patent [19]

Heinemann

[11] Patent Number: 5,054,702

[45] Date of Patent: Oct. 8, 1991

[54] ROTARY CRUSHING ROLL

[75] Inventor: Otto Heinemann, Ennigerloh, Fed. Rep. of Germany

[73] Assignee: Krupp Polysius AG, Fed. Rep. of Germany

[21] Appl. No.: 365,356

[22] Filed: Jun. 12, 1989

[51] Int. Cl.[5] ..... B02C 4/30

[52] U.S. Cl. ..... 241/230; 241/294; 241/300

[58] Field of Search ..... 241/117-122, 241/227, 230, 293, 294, 295, 300; 29/121.4, 127, 132

[56] References Cited

U.S. PATENT DOCUMENTS

| | | | |
|---|---|---|---|
| 3,622,412 | 11/1971 | Ross et al. | 29/132 X |
| 4,905,921 | 3/1990 | Faller | 241/294 |

FOREIGN PATENT DOCUMENTS

| | | | |
|---|---|---|---|
| 375705 | 5/1923 | Fed. Rep. of Germany | 241/295 |
| 3126563 | 5/1988 | Japan | 241/300 |
| 578292 | 6/1946 | United Kingdom | 241/300 |

*Primary Examiner*—Mark Rosenbaum

*Attorney, Agent, or Firm*—Learman & McCulloch

[57] ABSTRACT

The invention relates to a mill and to a method of applying a coating of wear-resistant material to the surface of a cylinder crushing shell. According to the invention the coating is formed by the winding of a profiled strip about the suface of the shell.

13 Claims, 4 Drawing Sheets

ROTARY CRUSHING ROLL

Figure 1:
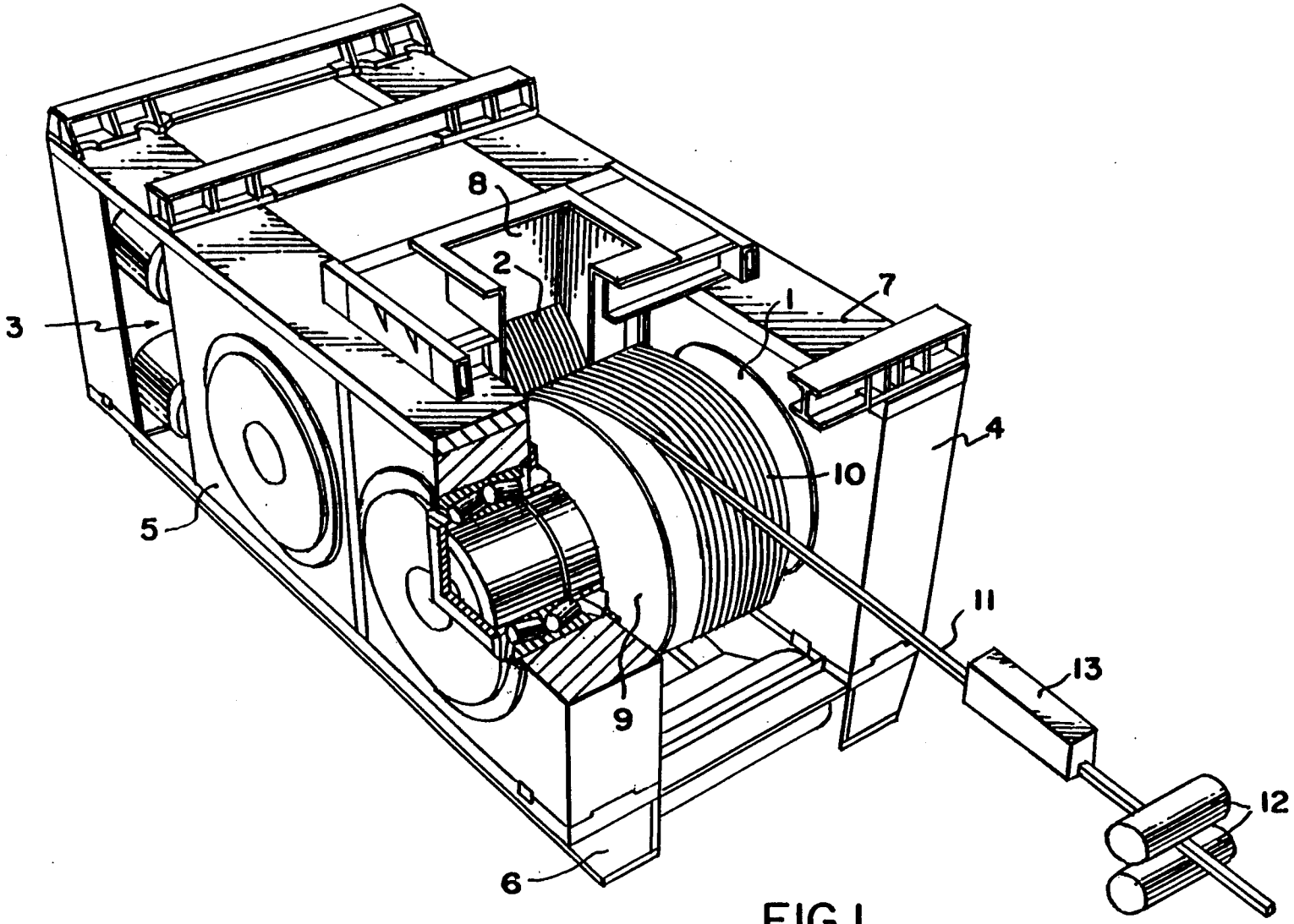

The invention relates to a mill and to a method of applying a wear-resistant coating to a crushing tool.

In roll mills the rolls are clad with very hard material as a protection against wear, and this is achieved by the application of a chilled cast binding or by welding on a hard layer.

These known constructions have certain disadvantages. Chilled cast bindings are very sensitive to impact and shock, whilst hard layers which are welded on are highly sensitive to overloading and continuous stress. Furthermore, both constructions are costly to produce and to repair.

The object of the invention, therefore, is to provide a mill and a method that economic production and repair are possible, extremely high degrees of hardness of the coating can be achieved and no damage to the base material of the cylindrical crushing roll during repair.

According to the invention the coating of the roll surface of the cylindrical crushing element is formed by the winding thereon of a profiled strip.

For this purpose the surface of the roll is wound around with at least one profiled strip made from wear-resistant material, and the individual turns of the winding lie closely against one another. The profiled strip is heated to hardening temperature and delivered in the heated state to the roll surface. On the roll surface the profiled strip is then cooled by a cooling agent.

After these operations tempering can be carried out in order to give the winding the desired elasticity or ductility.

Thus the invention facilitates an extraordinarily economical production of the wear-resistant coating of the roll, whereby suitable profiled strips of an extremely high degree of hardness can be achieved as required. It is also possible for the profiled strip which is fed to the roll during the winding to be provided with a surface profile on its surface forming the outer face of the winding.

Since the profiled strip is applied to the roll surface of the roll in a state in which it has been heated to hardening temperature and is then cooled on the roll surface, the winding shrinks on the roll which ensures the necessary firm seating of the winding on the roll.

Repair is possible in a very simple manner by applying a new coating, and in the case of a roller mill it is not necessary to remove the rollers. In the simple winding operation there is also no danger of damage to the basic body of the cylindrical crushing element.

The invention can advantageously be used in a roll mill containing two rolls which are driven in opposite directions, are pressed at high pressure against material to be crushed which is located between the rolls, and each has a winding of profiled strip on its surface.

It is, however, also possible to use the invention in a roller mill which has a grinding table and at least one crushing roller which forms the grinding element, the surface of the latter being provided with a winding of profiled strip.

If the invention is used in a roll mill it is of particular advantage if the bearings of this roll mill, the rolls of which are pressed during operation against the material to be crushed which is located between the rolls, can also readily absorb the radial forces which are generated by the tensile stress exerted on the profiled strip in the winding process.

Figure 10:
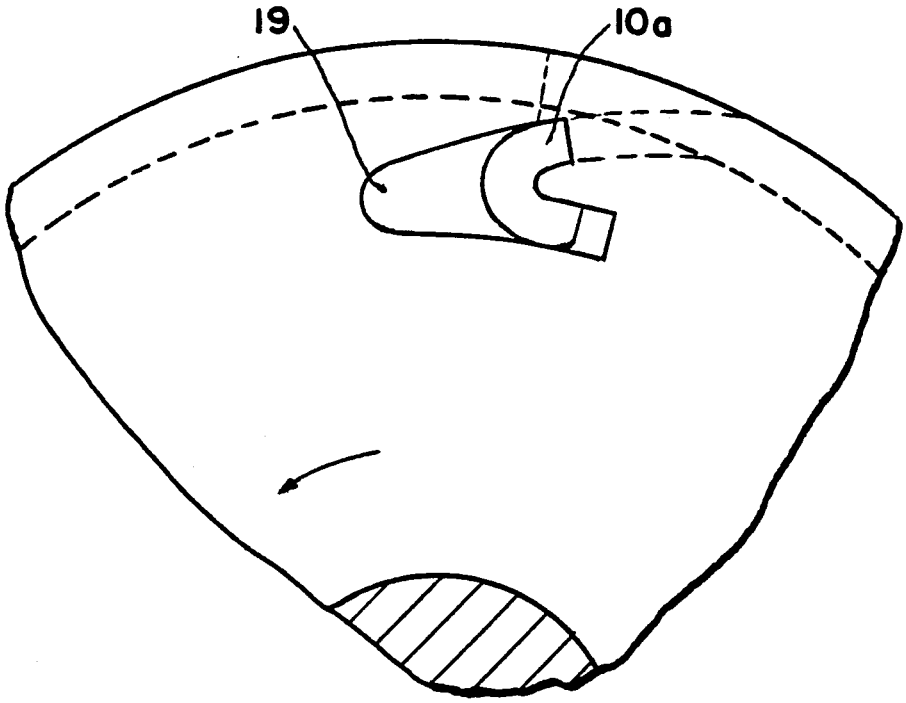
Figure 11:
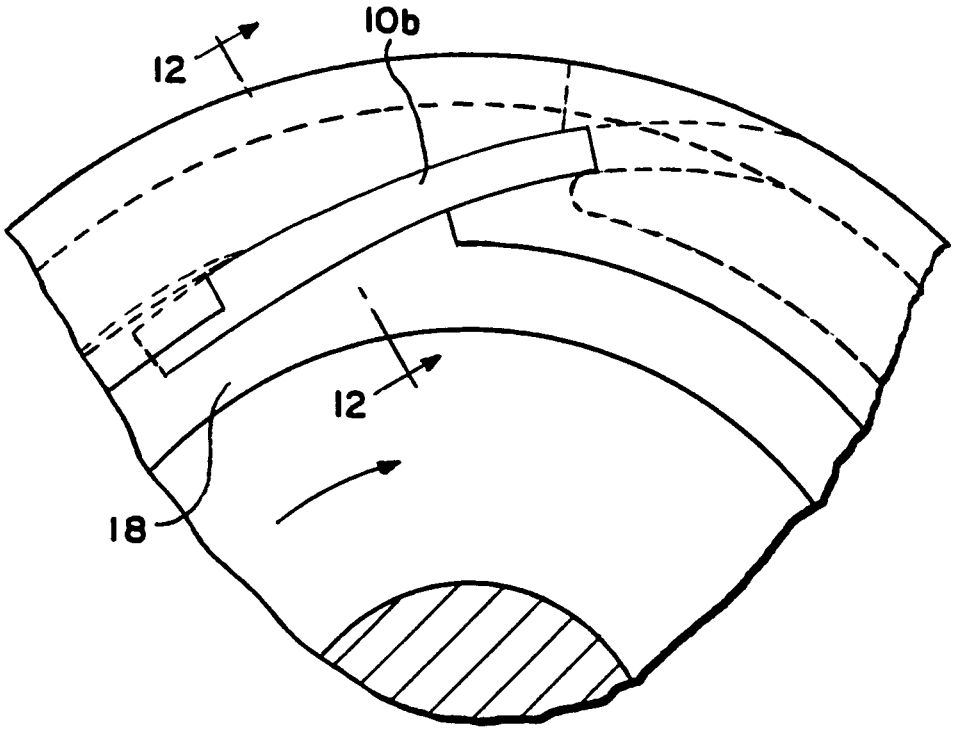
Figure 12:
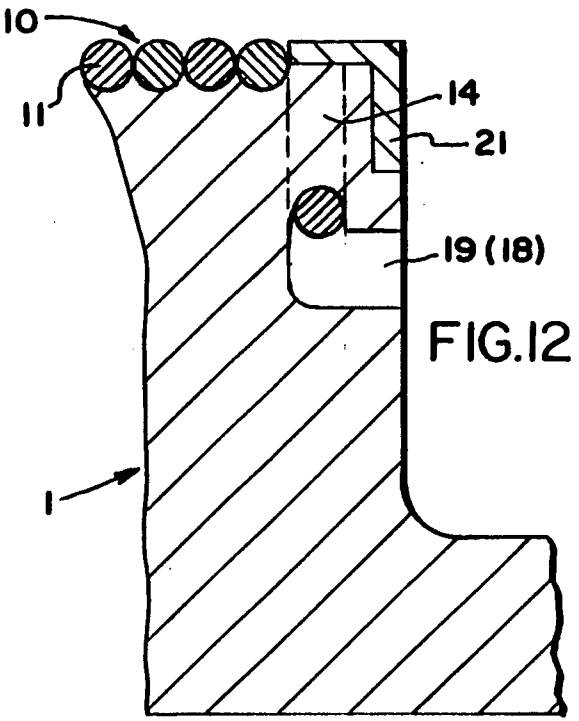
Figure 13:
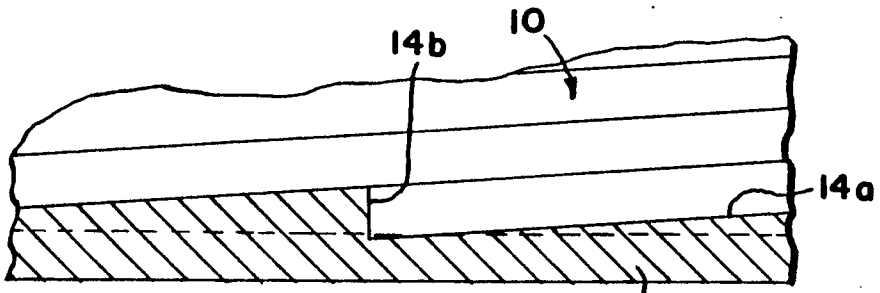

Several embodiments of the invention are illustrated in the drawings, in which:

FIG. 1 shows a roll mill (in perspective view) one roll of which has already been wound around, FIGS. 2 to 9 show schematic sectional representations of windings with different profiled strips, FIGS. 10 and 11 show partial views of the two ends of a roll, FIG. 12 shows a section along the line XII—XII in FIG. 11, FIG. 13 shows a plan view of the end region of the casing surface of the roller according to FIGS. 10, 11 and 12, FIGS. 14 and 15 show representations (corresponding to FIGS. 12 and 13) of a further embodiment).

The roll mill which is illustrated schematically in FIG. 1 and serves for the crushing of brittle material to be subsequently ground contains two rolls 1, 2 which are driven in opposite directions by drive means (not shown) and are pressed by means of a hydraulic arrangement 3 at high pressure against the material to be crushed which during operation is located between the rolls. The roll 1 is a fixed roll which is arranged in a bearing block 4, whilst the roll 2 is a floating roll which is mounted in a bearing block 5 which is movable by means of the hydraulic arrangement 3. The roll mill has a bed-frame 6 and an upper frame 7. A feed shaft 8 serves for delivery of the material which is to be crushed in the roll gap.

The roll 1 (and the same applies to the roll 2) has a basic shell or body 9 and a winding 10 which is applied to the surface of the basic body of the roll 9 and forms a wear layer to protect the basic body of the roll.

The winding 10 is formed by a profiled strip 11 which is applied to the roll 1 under tension and in a state in which it has been brought to hardening temperature. For this purpose braking rolls 12 are provided which hold the profiled strip 11 against the tension exerted by the driven roll 1.

A heating arrangement 13 which heats the profiled strip 11 to hardening temperature (e.g. 800° to 900° C.) is arranged after the braking rolls 12.

The profiled strip 11 is cooled on the roll 1 (for example after a rotation) by means of a cooling agent (e.g. an air or gas stream or a cooling fluid).

After the winding and hardening it is possible for tempering to be carried out. For this purpose the surface of the roller is heated to tempering temperature (e.g. 400° to 600° C.) and then slowly cooled. In this way the material which has become very brittle through the hardening process is given the desired elasticity or ductility.

Figure 2:
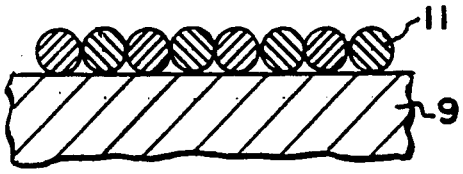
Figure 3:
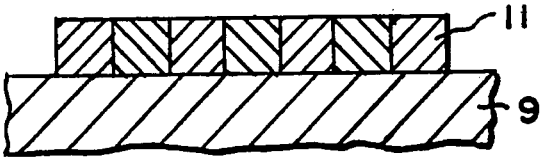
Figure 4:
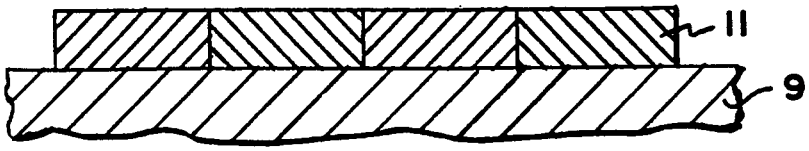
Figure 5:
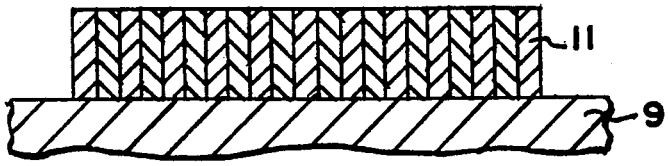

FIGS. 2 to 9 show different profiled strips for producing such a winding. In FIG. 2 a profiled strip with a round cross-section is used, in FIG. 3 a profiled strip with a square cross-section, in FIG. 4 a profiled strip with a horizontal rectangular cross-section, in FIG. 5 a profiled strip with a rectangular cross-section arranged upright.

Figure 6:
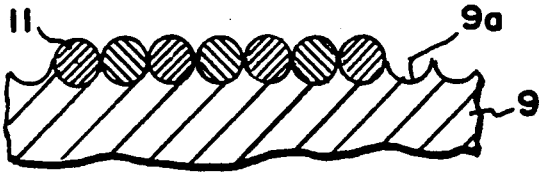
Figure 7:
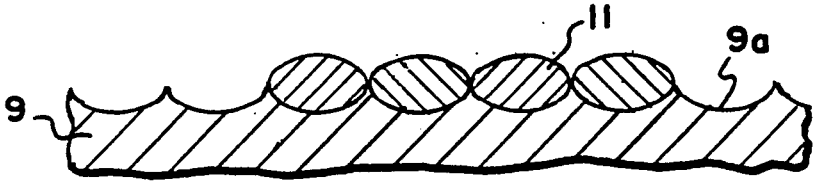
Figure 8:
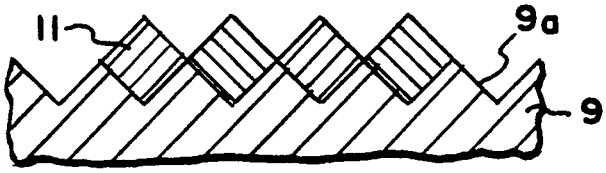
Figure 9:
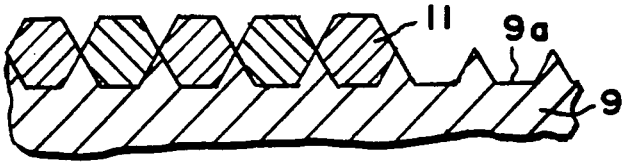

In the embodiments illustrated in FIGS. 6 to 9 the winding is set with a part of its cross-section, preferably approximately half of its cross-section, in recesses (e.g. 9*a*) of the surface of the basic body of the roll 9. The recesses 9*a* in the surface of the basic body of the roll 9 are adapted in shape and size to the cross-sectional profile of the profiled strip 11. In FIG. 6 the profiled strip has a circular cross-section, in FIG. 7 an elliptical cross-section, in FIG. 8 a square cross-section set on its point, and in FIG. 9 a hexagonal cross-section.

In all cases the profiled strip 11 is wound in the heated state onto the roll 1 and is cooled on the roll, which on the one hand effects the desired hardening of the steel and on the other hand ensures a firm seating of the winding on the basic body of the roll as a result of the shrinkage.

The smooth profiled strip which is heated to hardening temperature can pass through a pair of profiling rolls before being wound onto the basic body of the roll and is provided thereby with a profile on its surface which will form the outer face of the winding. When the said pair of profiling rolls is formed by the braking rolls 12, the heating arrangement 13 is to be arranged before this pair of rolls.

In order to shorten the length of profiled strip necessary for a winding and to accelerate the winding process, according to the invention a plurality of profiled strips can be wound simultaneously onto the roll in the form of a multiple winding.

FIGS. 10 to 13 show an embodiment for the fixing of the beginning and end of the winding (in a single winding).

In the region of each of the two end faces of the roll 1 the winding 10 butts against a flange 14 the external diameter of which corresponds to that of the winding 10. The collar 14 is provided with a groove-shaped recess 18 (or 19 at the other end of the roll) which serves to receive the beginning 10*a* or the end 10*b* of the winding 10.

The beginning of the winding 10*a* is bent back in a hook shape and fixed in the appertaining recess 19 (cf. FIG. 10). On the other hand, the end of the winding 10*b* which has just passed is arranged in the adjacent recess 18 so as to be freely extensible (cf. FIG. 11).

The flange 14 is provided with a protection against wear 21 on its outer peripheral edge and on the adjoining part of its end face (cf. FIG. 12).

The area of contact 14*a* of the flange 14 which butts against the winding 10 is inclined with respect to the axis of the roll according to the pitch of the winding 10 (cf. FIG. 13). A step 14*b* which runs in the axial direction of the roll is provided at the peripheral point at which the winding 10 emerges from or enters the flange 14.

Figure 14:
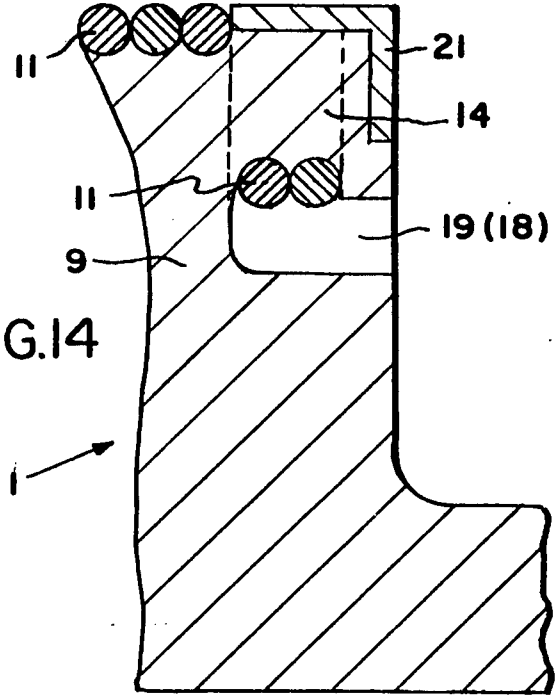
Figure 15:
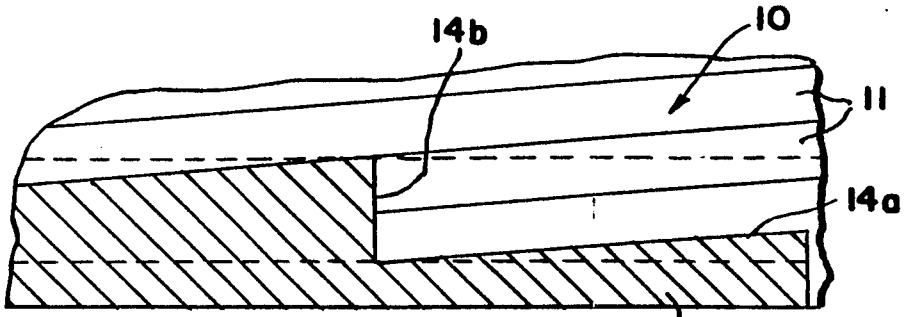

FIGS. 14 and 15 show the situation in the case of a double winding 10. The representation corresponds to that of FIGS. 12 and 13, and the same reference numerals are chosen for the same parts.

I claim:

1. A crushing mill for crushing brittle material for subsequent grinding comprising at least one rotary cylindrical crushing roll having an outer surface provided with a coating of wear-resistant material, characterised in that said coating is formed by a substantially uniform cross-section strip of said wear-resistant material helically wound on and secured to said roll, adjacent convolutions of said wound strip engaging one another to avoid the presence of a gap between said adjacent convolutions.

2. The mill according to claim 1 wherein said mill has two rolls rotatable in opposite directions, and means pressing at high pressure one of said rolls toward the other, each of said rolls having on its surface said strip.

3. The mill according to claim 1 wherein said mill comprises a grinding table and at least one crushing roll on which said strip is wound.

4. The mill according to claim 1 wherein said wound strip is set with a part of its cross-section snugly accommodated in recesses in the surface of said roll.

5. The mill according to claim 1 wherein said roll has two end faces and wherein at each of the two end faces the wound strip butts against a flange having an external diameter corresponding to that of the wound strip.

6. The mill according to claim 5 wherein said flange has a groove-shaped recess to receive one end of the wound strip.

7. The mill according to claim 6 wherein said one end of the wound strip is bent backwards in a hook shape and fixed in the recess in the flange.

8. The mill according to claim 6 wherein said wound strip has its other end accommodated in an adjacent recess in said flange.

9. The mill according to claim 5 wherein said flange is provided with wear resistant means on its outer surface.

10. The mill according to claim 5 wherein said flange has an area of contact which butts against the wound strip and is inclined with respect to the axis of rotation of said roll according to the pitch of the wound strip and has a step which extends in the axial direction at the peripheral point of said flange at which the wound strip emerges from or enters the latter.

11. The mill according to claim 1 wherein said wound strip is composed of multiple, parallel strands.

12. The mill according to claim 1 wherein said wound strip has a surface profile on its outer face.

13. A crushing mill for crushing brittle material for subsequent grinding comprising at least one rotary cylindrical crushing roll terminating at its opposite ends in peripheral flanges, and a continuous strip of wear-resistant material helically wound on said roll and spanning the distance between said flanges, adjacent convolutions of said wound strip engaging one another to avoid the presence of a gap between said adjacent convolutions and the external diameter of said wound strip corresponding to that of said flanges.

* * * * *